US006905322B1

(12) United States Patent
Simonds

(10) Patent No.: US 6,905,322 B1
(45) Date of Patent: Jun. 14, 2005

(54) CAM PUMP

(75) Inventor: Edward L. Simonds, Adel, IA (US)

(73) Assignee: Thermal Dynamics, Inc., Adel, IA (US)

( * ) Notice: Subject to any disclaimer, the term of this patent is extended or adjusted under 35 U.S.C. 154(b) by 0 days.

(21) Appl. No.: 10/253,560

(22) Filed: Sep. 24, 2002

(51) Int. Cl.[7] ..... F03C 2/00
(52) U.S. Cl. ..... 418/264; 418/246; 418/262
(58) Field of Search ..... 418/262–264, 418/246

(56) References Cited

U.S. PATENT DOCUMENTS

| | | | | | |
|---|---|---|---|---|---|
| 741,059 | A | * | 10/1903 | Mullen | 418/263 |
| 1,115,470 | A | | 10/1914 | Lipman | |
| 1,121,628 | A | * | 12/1914 | Hoffman | 418/263 |
| 1,269,937 | A | * | 6/1918 | Hutsell | 418/263 |
| 1,309,096 | A | * | 7/1919 | Leibing | 418/246 |
| 1,492,456 | A | | 4/1924 | Hansen-Ellehammer | |
| 2,295,117 | A | | 9/1942 | Koester | |
| 2,463,155 | A | | 3/1949 | Dawes | |
| 2,636,480 | A | | 4/1953 | Becker | |
| 2,671,411 | A | | 9/1954 | Rhine | |
| 2,799,371 | A | | 7/1957 | Osborn | |
| 2,915,048 | A | * | 12/1959 | Osborn | 418/264 |
| 2,960,075 | A | * | 11/1960 | Phillips | 418/264 |
| 3,368,537 | A | | 2/1968 | Antonio | |
| 3,455,245 | A | | 7/1969 | Reichling | |
| 3,787,150 | A | | 1/1974 | Sarich | |
| 3,804,562 | A | | 4/1974 | Hansson | |
| 3,812,828 | A | | 5/1974 | Griffiths | |
| 3,828,555 | A | | 8/1974 | Capdevielle | |
| 3,938,426 | A | | 2/1976 | Hunter | |
| 3,988,083 | A | | 10/1976 | Shimizu et al. | |
| 3,989,426 | A | | 11/1976 | Sato et al. | |
| 4,241,713 | A | | 12/1980 | Crutchfield | |
| 4,712,789 | A | | 12/1987 | Brilando | |
| 4,757,988 | A | | 7/1988 | Szymski | |
| 4,789,317 | A | | 12/1988 | Waser et al. | |
| 4,898,524 | A | | 2/1990 | Butzen | |
| 4,902,001 | A | | 2/1990 | Balbo | |
| 4,986,402 | A | | 1/1991 | Neuwirth | |
| 4,998,868 | A | | 3/1991 | Sakamaki et al. | |
| 5,002,473 | A | | 3/1991 | Sakamaki et al. | |
| 5,011,390 | A | | 4/1991 | Sakamaki et al. | |
| 5,030,074 | A | | 7/1991 | Sakamaki et al. | |
| 5,284,427 | A | | 2/1994 | Wacker | |
| 5,461,863 | A | | 10/1995 | Simonds | |

(Continued)

FOREIGN PATENT DOCUMENTS

DE 2029 280 6/1970

(Continued)

*Primary Examiner*—Theresa Trieu
(74) *Attorney, Agent, or Firm*—Brett Trout

(57) ABSTRACT

A motor for converting fluid pressure to rotational motivation, and pump for moving fluid, is provided. The motor/pump includes a drum provided within a cylindrical cavity defined by a housing. Vane assemblies are provided which extend through the inner drum, and are actuated to extend and retract through their operable coupling to a cam provided within the inner drum. As the inner drum rotates, the vanes extend and retract, alternately increasing and decreasing their drag coefficient, causing pressurized fluid admitted into the interior to drive the vanes and inner drum in a single direction. Alternatively, a power source may be coupled to the motor to drive the motor, thereby causing it to act as a pump for moving fluid from one location to another.

17 Claims, 16 Drawing Sheets

U.S. PATENT DOCUMENTS

| | | | |
|---|---|---|---|
| 5,533,566 | A | 7/1996 | Fineblum |
| 5,551,854 | A | 9/1996 | Edwards |
| 5,617,936 | A | 4/1997 | Nemoto |
| 5,816,789 | A | 10/1998 | Johnson |
| 5,961,310 | A | 10/1999 | McClure |
| 5,967,016 | A | 10/1999 | Simonds |
| 5,974,943 | A | 11/1999 | Simonds |
| 6,024,549 | A | 2/2000 | Lee |
| 6,203,041 | B1 | 3/2001 | Helm |
| 6,453,793 | B1 | 9/2002 | Simonds |

FOREIGN PATENT DOCUMENTS

| | | | |
|---|---|---|---|
| DE | 4341394 | A | 4/1994 |
| FR | 2169500 | A | 9/1973 |
| GB | 392999 | | 6/1933 |
| GB | 743 088 | A | 1/1956 |
| JP | 61-83492(A) | | 9/1984 |
| JP | 01-290924 (A) | | 5/1988 |
| WO | WO 82/01215 | | 4/1982 |

* cited by examiner

CAM PUMP

BACKGROUND OF THE INVENTION

1. Field of the Invention

The present invention relates in general to a fluid motor for converting fluid pressure to rotational motivation, and capable of pumping fluid when rotational motivation is applied to the motor, and, more specifically, to a fluid pressure motor with pumping capabilities utilizing a cam actuated vane.

2. Description of the Prior Art

Motors for converting fluid pressure to rotational motivation are generally known in the art. Two types of such motors are the turbine motor and the vane motor. A turbine motor includes a circular shell, having an inlet on its circumference and an exhaust at its center. A plurality of radially-extending, curved fins is provided within the shell. Pressurized fluid is provided into the shell through the inlet. The pressurized fluid pushes outward against the curved fins to rotate the fins before exiting through the exhaust port at the center of the circular shell.

One drawback of turbine motors is the high operating speeds typically required to develop sufficient torque. High operating speeds also make turbine motors susceptible to contamination. If particulate matter enters a turbine motor, the vanes of the turbine motor strike the particulate matter at high speed, causing damage to the vanes. Due to the high speed, even very small particulate matter can erode or destroy a vane. An additional drawback of the turbine motor is its inefficiency at low speeds. Turbine motors typically cannot start against an applied load. If a load were applied to a turbine motor before the vanes began to rotate, pressurized fluid applied through the inlet would simply exit directly out the exhaust port without rotating the vanes. Additionally, turbine motors are incapable of generating reverse rotational motion. If fluid were provided to the motor in a reverse direction, the vanes would still rotate in the same direction. Accordingly, a transmission is required to operate turbine motors efficiently at various speeds and reversing gears are required to generate reverse torque using a turbine motor.

Like a turbine motor, a vane motor has a plurality of radially-extending vanes. Unlike a turbine motor, however, the vanes of a vane motor are straight and extensible in relation to a center cylinder. The vanes of a vane motor are received in slots provided in the center cylinder. The vanes and center cylinder are provided within an elliptical shell. Fluid is supplied into the shell through a fluid input provided along the circumference of the shell. The fluid presses against the vanes and propels the center cylinder before exiting from an exhaust also provided along the circumference of the shell. Rotation of the center cylinder throws the vanes outward against the interior walls of the shell. Since the exterior shell is elliptical, and the vanes extend to the exterior shell, more of the vanes are exposed as the vanes pass the drive side of the exterior shell than is exposed as the vanes pass the recovery side of the exterior shell.

As the vanes pass by the drive side of the shell, the walls of the shell force the vanes into the slots. Conversely, as the vanes pass the recovery side of the shell, the vanes are thrown outward to their full extension. This extension and retraction of the vanes reduces the exposed surface area of the vanes to reduce undesired counter thrust. The vanes are, however, at least partially extended throughout the rotation. A certain portion of the fluid, therefore, presses against the vanes, imparting undesired counter force. Accordingly, a certain amount of fluid pressure goes toward applying force to the vanes in the reverse direction. Not only is this counter force unavailable to drive the vanes in the desired direction, but the counter force makes driving the vanes more difficult.

Accordingly, vane motors are a relatively inefficient conversion of fluid pressure to rotational motion. Additionally, the vanes rub against the exterior shell, reducing the lifespan of the vanes and typically requiring continuous lubrication. Operating vane motor at high speeds will often reduce the lifespan of the vanes even further. Although vane motors can produce torque at low speeds, unlike turbine motors, vane motors have a relatively narrow band of fluid pressures over which the most efficient torque is obtained. Due to this narrow band of efficiency, vane motors also must be used in conjunction with a transmission to obtain efficient rotational motion at multiple shaft speeds.

Prior art fluid pressure rotational motors typically have an outer shell containing a plurality of vanes rotating about an axis at the center of the shell. Due to their design, prior art motors have numerous unique disadvantages, as well as the common disadvantages of inefficiency of operation and a narrow band of fluid pressures over which the most efficient torque is produced. It would be desirable to provide a fluid motor with an efficient production of torque over a wide range of fluid pressures, to provide not only a stable rotational torque, but also to eliminate the need for a transmission and a reverse gear. It would also be desirable to provide a long-wearing motor capable of withstanding vane contact with small amounts of particulate matter. The difficulties encountered in the prior art discussed hereinabove are substantially eliminated by the present invention.

SUMMARY OF THE INVENTION

In an advantage provided by this invention, a fluid motor produces torque over a wide range of fluid pressures.

Advantageously, this invention provides an efficient conversion of fluid pressure to rotational motivation.

Advantageously, this invention provides a long wearing fluid motor of low cost construction.

Advantageously, this invention provides a fluid motor capable of operating with particulate matter provided within a driving fluid.

Advantageously, this invention provides a fluid motor with a reduced number of wear points.

Advantageously, this invention provides an efficient conversion of rotational motivation to fluid movement.

Advantageously, this invention provides a fluid motor of economical construction.

Advantageously, in a preferred example of this invention, a motor is provided comprising a housing defining a fluid input and a fluid output in fluid communication with an interior, a vane provided within the housing, a cam provided within the housing, a follower operably coupled to the vane, and means for maintaining the follower in contact with the cam.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
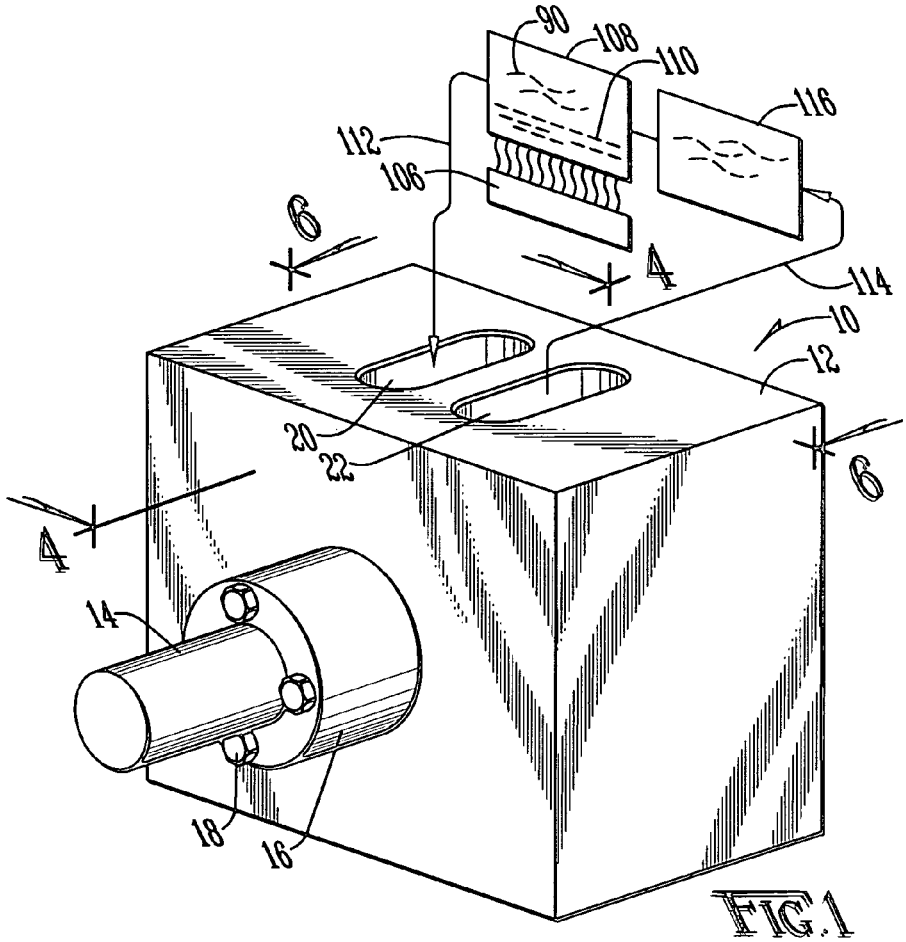
FIG. 1 illustrates an example perspective view of a motor according to this invention.
Figure 2:
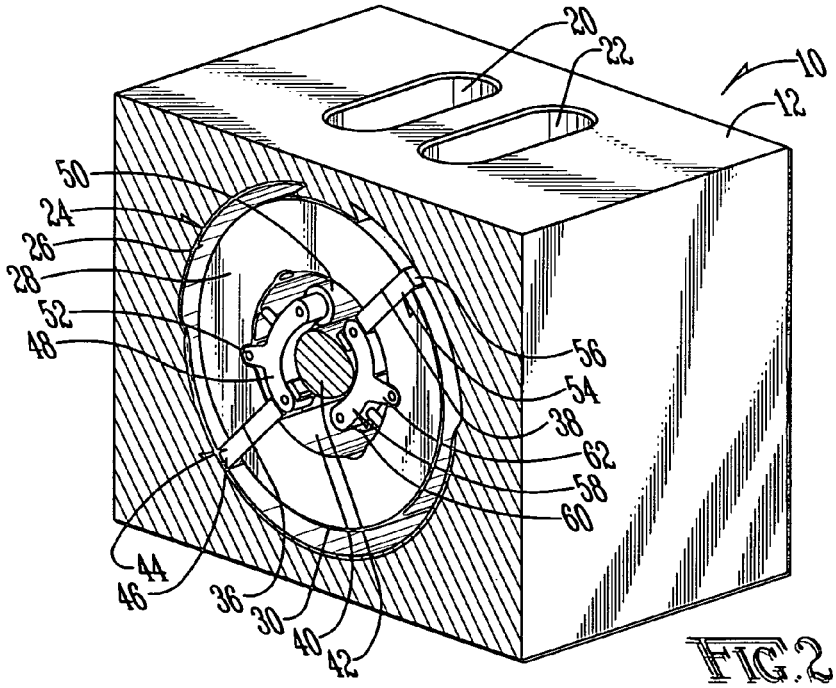
FIG. 2 illustrates a rear perspective view of the motor of FIG. 1, shown with the rear of the case and the shaft bushings removed.
Figure 4:
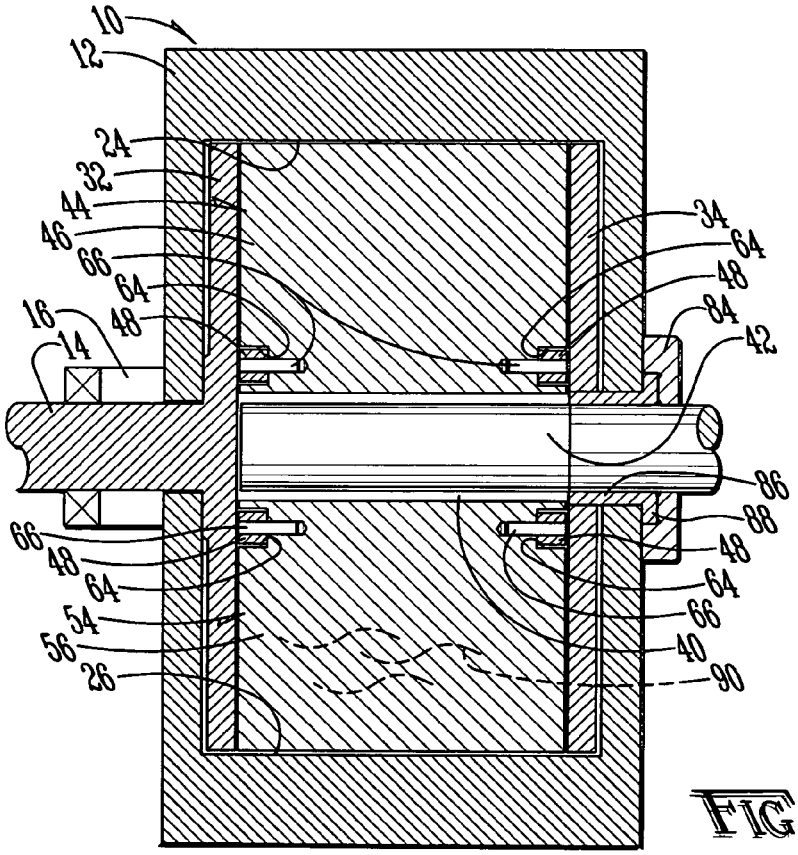
FIG. 4 illustrates a side elevation cross-section of the motor taken along line 4—4 of FIG. 1 shown with the vanes in the maximum-extension and maximum-retraction orientation.

Referring to FIG. 1, a motor (10) according to this invention is shown with the drive shaft (14) coupled to a casing (12) by a bushing (16). The bushing (16), in turn, is secured to the casing (12) by bolts (18). As shown in FIG. 2, the casing (12) is provided with a fluid inlet (20) and a fluid outlet (22). The casing (12) is provided with a hollow interior (24) in fluid communication with the inlet (20) and outlet (22). The hollow interior (24) is defined by an outer race (26). Provided within the hollow interior (24) is an inner drum (28), which comprises a front plate (32), back plate (34), and a cylindrical inner race (30). (FIGS. 2 and 4). As shown in FIG. 2, the inner race (30) is provided with a first aperture (36) and a second aperture (38). The apertures (36) and (38) open into a cylindrical interior (40) containing a cam (42).

In addition to the cam (42), provided within the interior (40) of the inner drum (28) is a first vane assembly (44) which includes a first vane (46) coupled to a pair of pivot arms (48). Pivotally coupled to the inner drum (28), the pivot arms (48) are each provided with a hardened bearing (50) journaled to the pivot arms (48). The pivot arms (48) are also provided with a tab (52) which, in turn, is pivotally coupled to the inner drum (28), as shown in FIG. 2.

Figure 5:
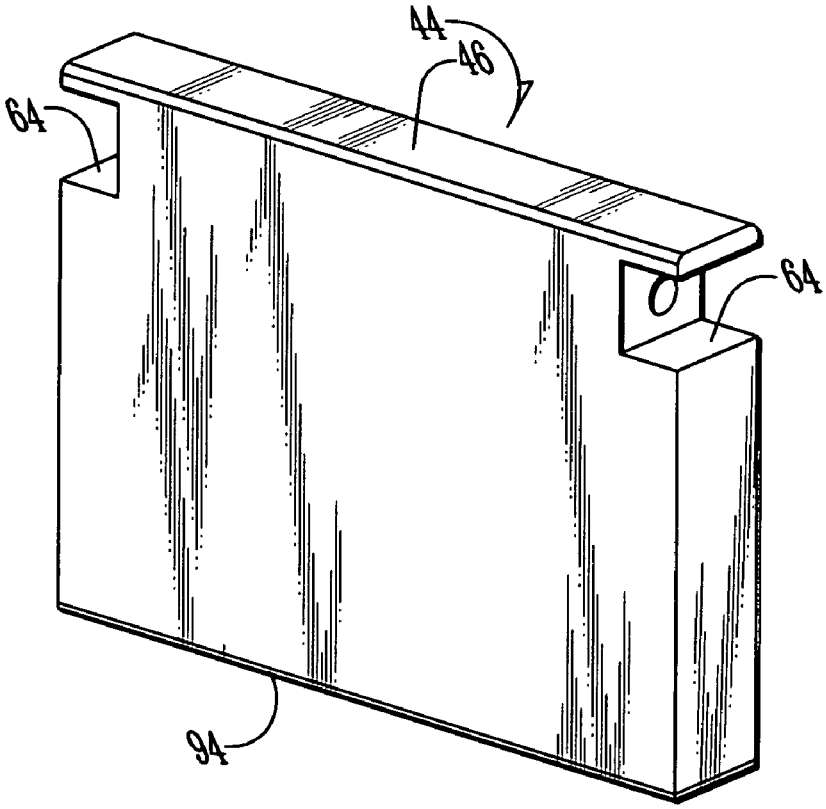
FIG. 5 illustrates a front perspective view of a vane of the present invention.
Figure 6:
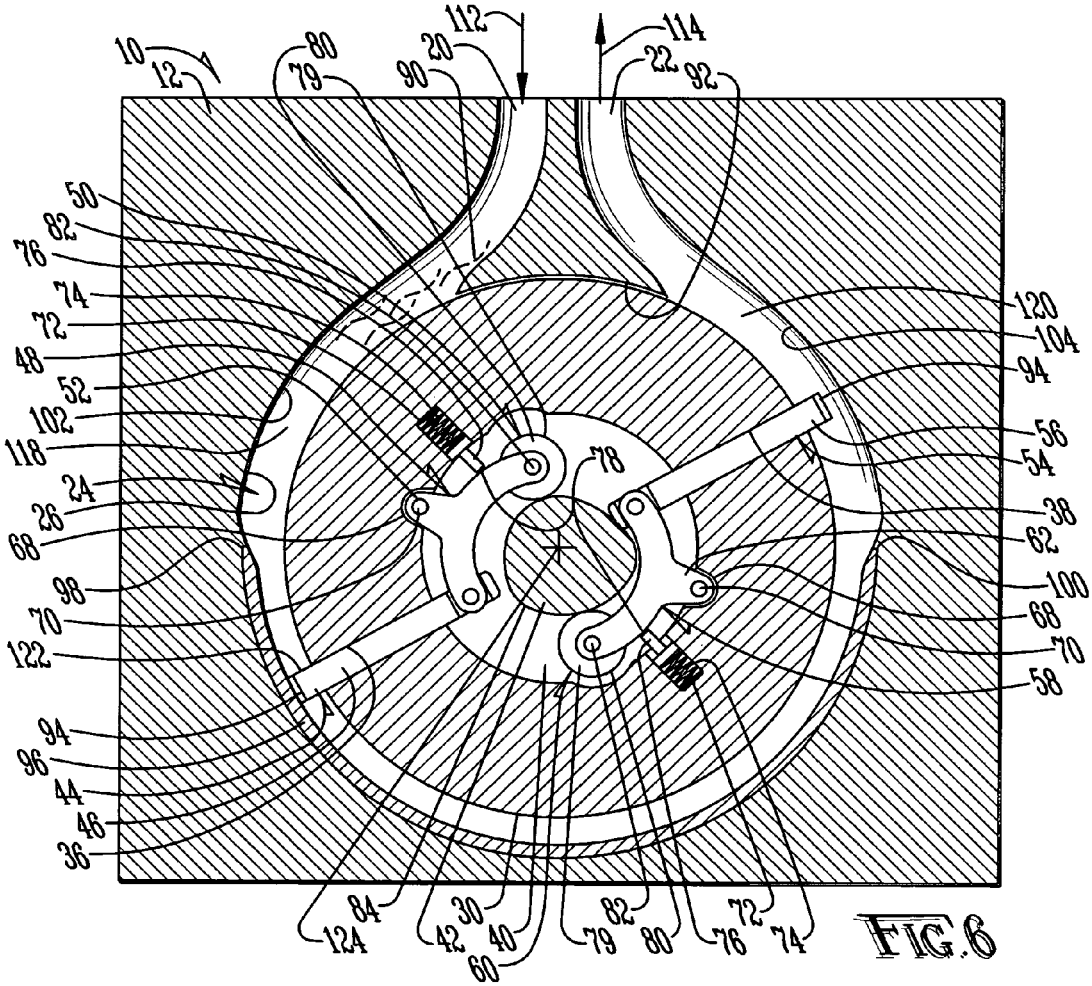
FIG. 6 illustrates a rear elevation cross-section of the motor taken along line 6—6 of FIG. 1.

A second vane assembly (54) is also provided, comprising a second vane (56), a pair of pivot arms (58), each provided with a bearing (60) and tab (62) secured to the inner drum (28) as described above. As shown in FIGS. 4 and 5, the vanes (46) and (56) are provided with cutout (64) to accommodate the pivot arms (48) and (58). As shown in FIG. 6, although the pivot arms (48) and (58) may be simply provided within the cutout (64), in the preferred embodiment, the pivot arms (48) and (58) are journaled to the vanes (46) and (56) within the cutout (64) with pins (66) or other means known in the art.

Figure 3:
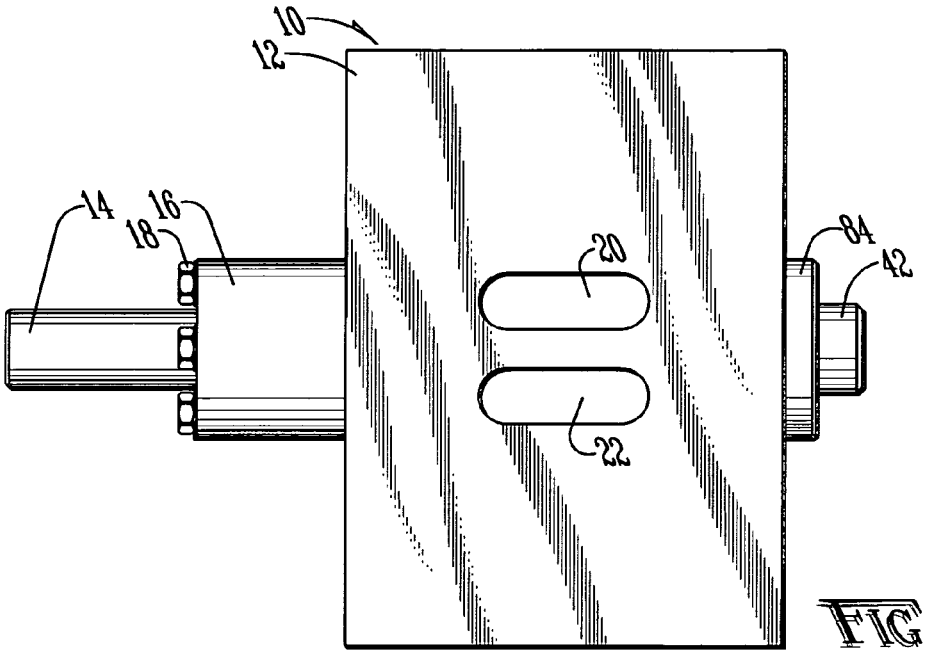
FIG. 3 illustrates a top plan view in partial phantom of the motor of FIG. 1.

As shown in FIG. 6, the inner drum (28) is also provided with a pair of recesses (68) into which the tabs (52) and (62) are provided, and by which the pivot arms (48) and (58) are journaled to the inner drum by pins (70) or the like. The inner drum (28) is also provided with another set of recesses (72) housing a coiled steel spring (74) or similar resilient material coupled to a shaft (76), which is in contact with the pivot arms (48) and (58). The shaft (76) is preferably provided on its tip (78) with Teflon® or similar low-friction material which, as shown in FIG. 6, is biased into contact with the pivot arms (48) and (58) by the spring (74). In the preferred embodiment, the bearings (50) and (60) comprise low-friction wheels (79) having a surface (80) coated with Teflon® or similar low-friction material. The bearings (50) and (60) are preferably secured to the pivot arms (48) and (58) by a low-friction axle assembly (82), such as those well known in the art. Similarly, the surface (84) of the cam (42) is provided with Teflon® or similar low-friction material. As shown in FIGS. 3–4, provided around the cam (42) is a support bracket (84), secured to the casing (12). As shown, the cam (42) is centered within the hollow interior (24) defined by the outer race (26). As shown in FIG. 4, the drive shaft (14) is centered on the front plate and welded and secured thereto on the same axis as the cam (42). As shown in FIG. 6, the cam (42) is of a non-circular cross-section. Preferably, the dimensions of the cam are such that as the inner drum (28) rotates, the vanes extend and retract as described in more detail below. As the cam (42) is non-circular in dimension, the back plate (34) is provided with a large, circular aperture (86) into which is secured a bearing (88). The bearing (88) supports the inner drum (28) against the casing (12) and allows the cam (42) to extend out of the casing (12) and be secured thereto by the support bracket (84). The bearing (88) also maintains a substantially fluid tight seal to prevent the escape of pressurized fluid (90) out of the casing (12).

As shown in FIG. 6, the inner race (30) is positioned close to a ceiling (92) defined by the casing (12). In the preferred embodiment, the curvature of the ceiling (92) is substantially similar to the curvature of the inner race (30). The inner race (30) is preferably positioned within five millimeters of and, more preferably, within one millimeter of the ceiling (92) to limit the flow of pressurized fluid (90) therebetween. The inner race (30) is preferably positioned no closer than 1/100 of a millimeter to the ceiling (92) and, more preferably, positioned no closer than 1/10 of a millimeter to the ceiling (92) to reduce wear on tips (94) of the vanes (46) and (56), and to prevent particulate (not shown) from damaging the motor (10).

The outer race (26) is provided with an abrasion plate (96), preferably constructed of titanium or similar abrasion resistant material. As shown, the casing (12) is provided with a first slot (98) and a second slot (100) into which the ends of the abrasion plate (96) are friction fit. As shown in FIG. 6, the inner race (30) has a substantially similar radius of curvature to the ceiling (92). Similarly, the inner race (30) has a substantially similar radius of curvature to the outer race (26). As shown in FIG. 6, the casing (12) defines an intake sidewall (102) and an exhaust sidewall (104).

Any suitable source may be used to produce the pressurized fluid (90) to operate the motor (10), including any suitable gas or liquid known in the art. (FIG. 6). In the preferred embodiment, the pressurized fluid (90) is steam, generated by a heater (106). (FIGS. 1–6). The heater (106) heats a heating chamber (108) provided with water (110). (FIG. 1). The heating chamber (108) is coupled by a pressure hose (112) to the inlet (20). Similarly, the outlet (22) is coupled to a return hose (114) which, in turn, is coupled to a condenser (116) in fluid communication with the heating chamber (108).

To operate the motor (10) of the present invention, the heater (106) is engaged to provide sufficient heat to the heating chamber (108) to vaporize the water (110) and move the resulting pressurized fluid (90) through the pressure hose (112) into the inlet (20) of the casing (12). (FIGS. 1 and 6). From the inlet (20) the pressured fluid (90) enters an inlet chamber (118) defined by the intake sidewall (102) and an outer arcuate surface (120) of the inner race (30). (FIG. 6). As shown in FIG. 6, as the pressurized fluid (90) enters the inlet chamber (118), the pressurized fluid (90) presses against a face (122) of the first vane (46), forcing the inner drum (28) into a counterclockwise rotation.

Figure 7:
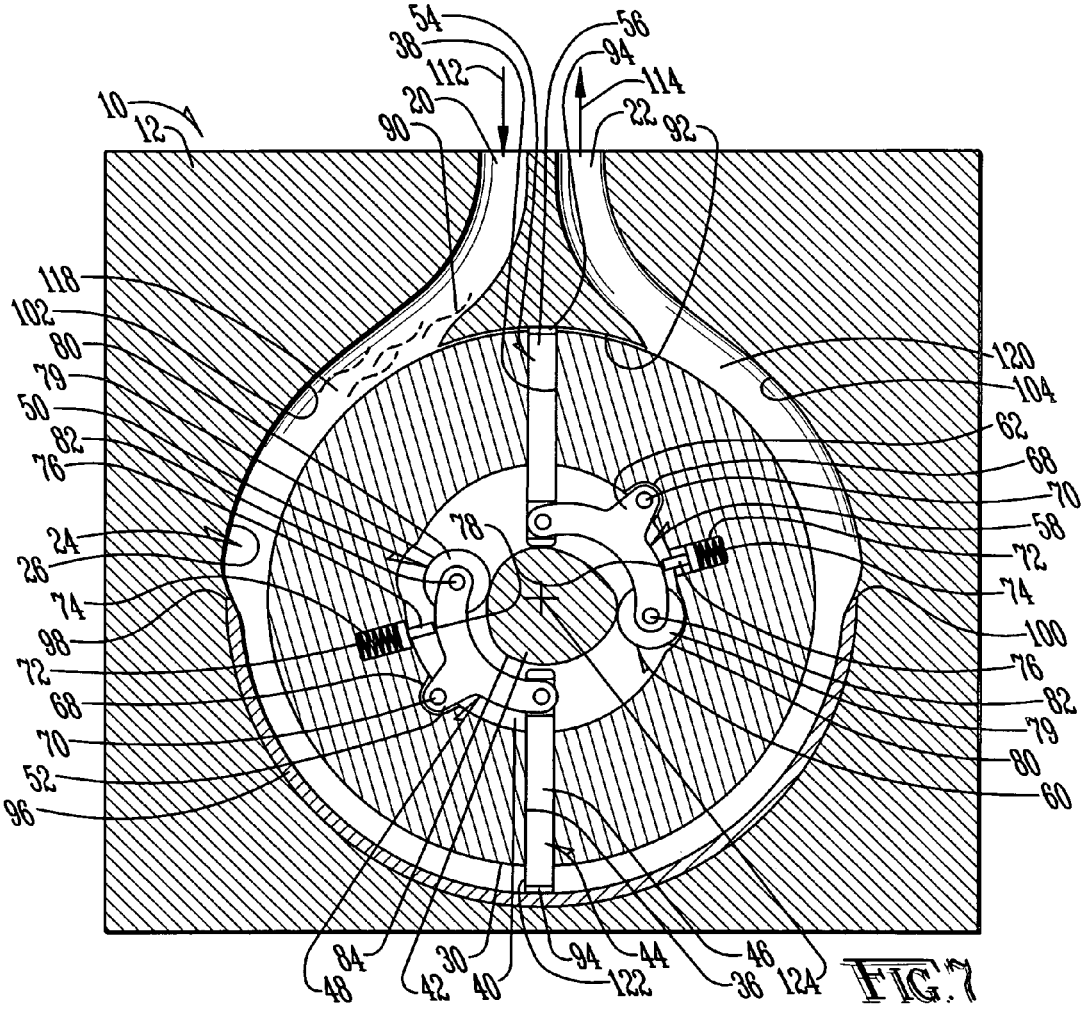
FIG. 7 illustrates a rear elevation cross-section of the motor of FIG. 6, shown with one vane fully retracted and one vane fully extended.

As shown in FIG. 7, the rotation continues until the first vane (46) is closest to the ceiling (92). At this point, the majority of the first vane (46) is located within the inner drum (28). Accordingly, the amount of the first vane (46) exposed to the pressurized fluid (90) is reduced, as is its drag coefficient. A larger drag coefficient would allow the pressurized fluid (90) to force the inner drum (28) toward a clockwise rotation, thereby reducing the efficiency of the motor (10). As shown in FIG. 7, as the pressurized fluid (90) presses against the face (122) of the second vane (56), the second vane (56) moves along the abrasion plate (96) with the gap between the second vane (56) and the abrasion plate (96) preferably being less than five millimeters and, more preferably, less than one millimeter, while being preferably greater than 1/100 of a millimeter and, more preferably, more than 1/50 of a millimeter.

As the pressurized fluid (90) continues to press against the face (122) of the second vane (56), the second vane (56) rotates the inner drum (28). As the inner drum (28) rotates toward the orientation shown in FIG. 7, the bearing (60) secured to the second set of pivot arms (58) ride along a shallow portion of the cam (42), thereby causing the bearing (60) to move closer to the center (124) of the motor (10). As the bearing (60) moves closer to the center (124), the pivot arms (58) pivot on their tab (62), thereby forcing the opposite end of the pivot arms (58) outward. As the second vane (56) is coupled to this portion of the pivot arms (58), the action forces the second vane (56) outward as well. The spring (74) and shaft (76) coact to maintain the bearing (60) in contact with the cam (42).

Conversely, as the first vane (46) moves toward the position shown in FIG. 7, the bearings (50) coupled to the first set of pivot arms (48) move along a deep portion of the cam (42). This causes the pivot arms (48) to press against the pins (76) and retract the spring (74). As the first set of pivot arms (48) pivot on the tabs (52), the opposite end of the pivot arms (48) move toward the center (124) of the motor (10), thereby drawing the first vane (46) into the inner drum (28) as the first vane (46) passes the ceiling (92). This retraction reduces the drag coefficient of the first vane (46) when the first vane (46) is near the ceiling (92), to reduce reverse torque on the inner drum (28). Conversely, the extension of the second vane (56) increases the drag coefficient of the second vane (56) as the second vane (56) travels along the abrasion plate (96), which allows the pressurized fluid (90) to provide maximum counterclockwise torque to the inner drum (28) through the vane (56).

Figure 8:
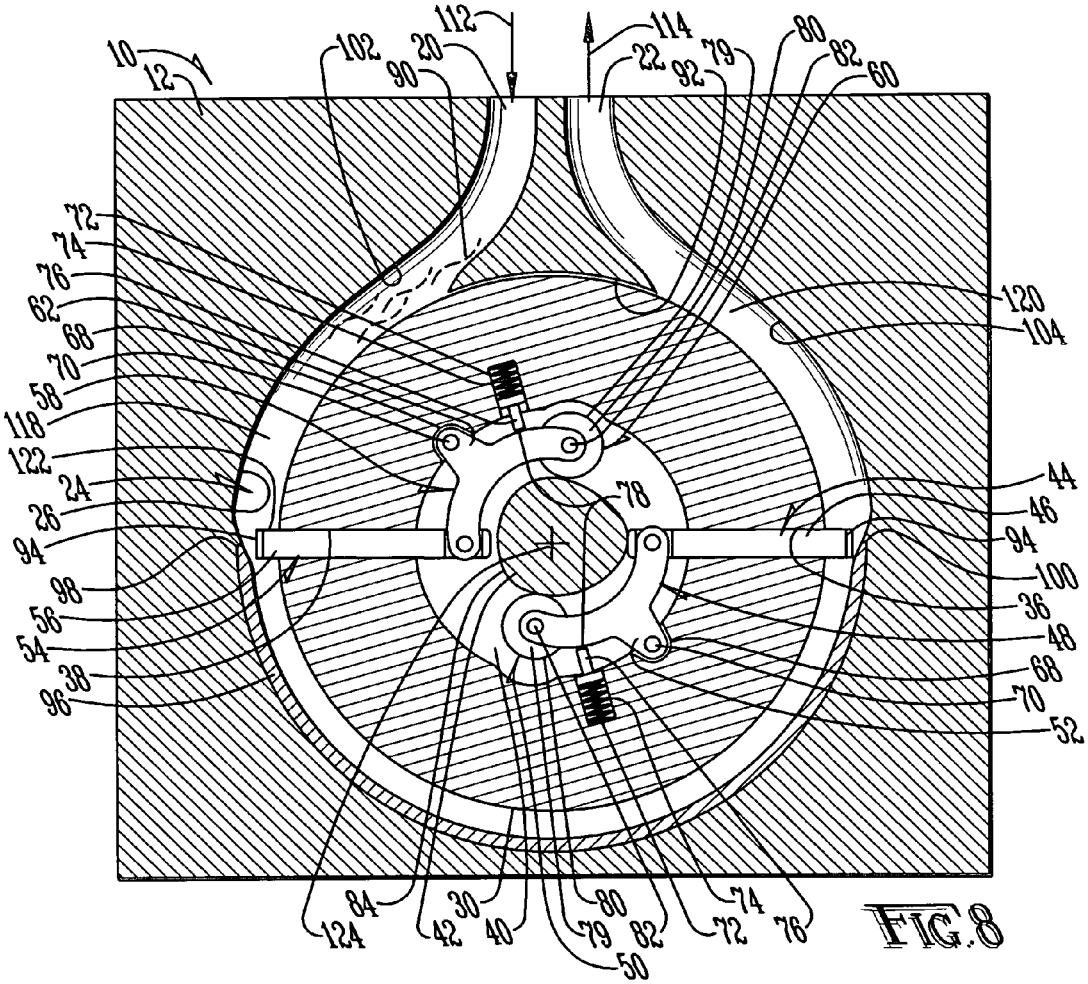
FIG. 8 illustrates the motor of FIG. 6, shown with the two vanes equally extended.

As shown in FIG. 8, as the second vane (56) moves past the abrasion plate (96), the pressurized fluid (90) enters an exhaust chamber (126), defined by the exhaust sidewall (104) and the outer arcuate surface (120) of the inner race (30). (FIG. 8). From the exhaust chamber (126), the pressurized fluid (90) exits the outlet (22), passes through the return hose (114) to the condenser (116) and on to the heating chamber (118) as water (110). (FIGS. 1 & 8). Although the motor (10) may be constructed of any suitable material, in the preferred embodiment, all of the materials are constructed of stainless steel, except for the bushing (16), bearings (50) and (60), tips (94), abrasion plate (96), pressure hose (112) and return hose (114), which are constructed from material described herein, or from standard, known materials suitable for their intended purpose, such as rubber hose material. Of course, the motor (10) may be constructed of aluminum, brass, plastic or any other material known in the art.

The bushing (16) and bearings (50) and (60) may include stainless steel bearings, Teflon® bushings, or other suitable material known in the art. The motor (10) may be constructed of any suitable dimensions, from several angstroms to several meters in length. Preferably, the motor (10) is constructed of a block approximately one cubic centimeter to one cubic meter in size and, more preferably, twenty-five cubic centimeters to one-half cubic meter in size.

Figure 9:
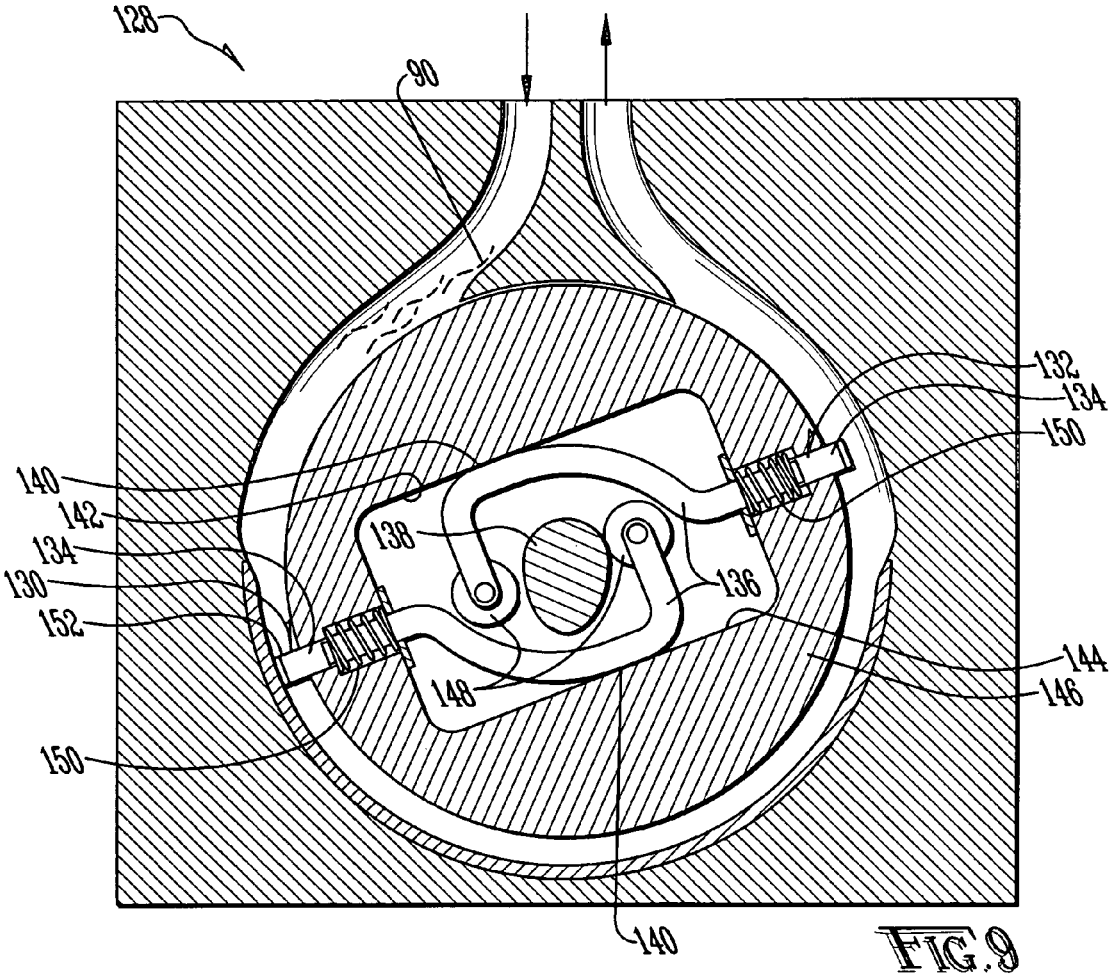
FIG. 9 illustrates a rear elevation cross-section of an alternative embodiment of the present invention.
Figure 10:
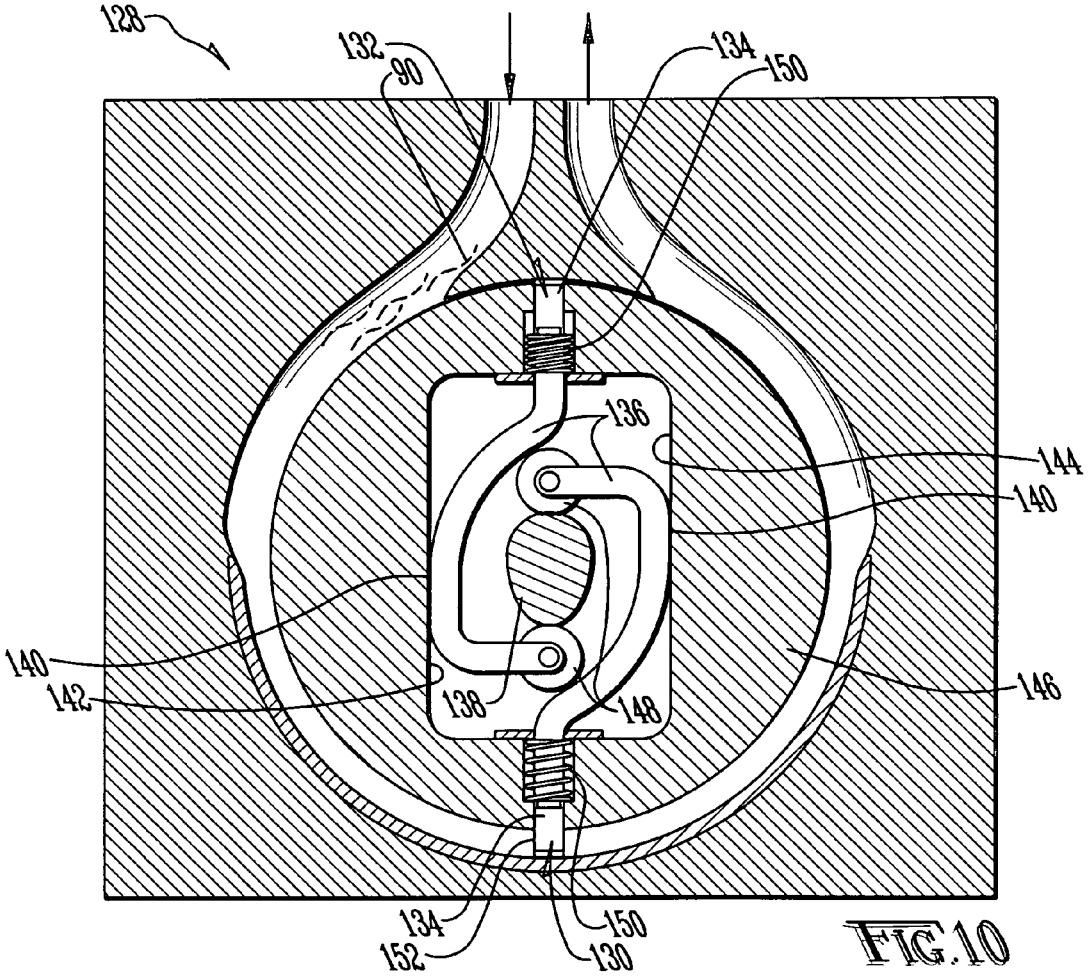
FIG. 10 illustrates a rear elevation cross-section of the motor of FIG. 9, shown with one vane fully retracted and one vane fully extended.
Figure 11:
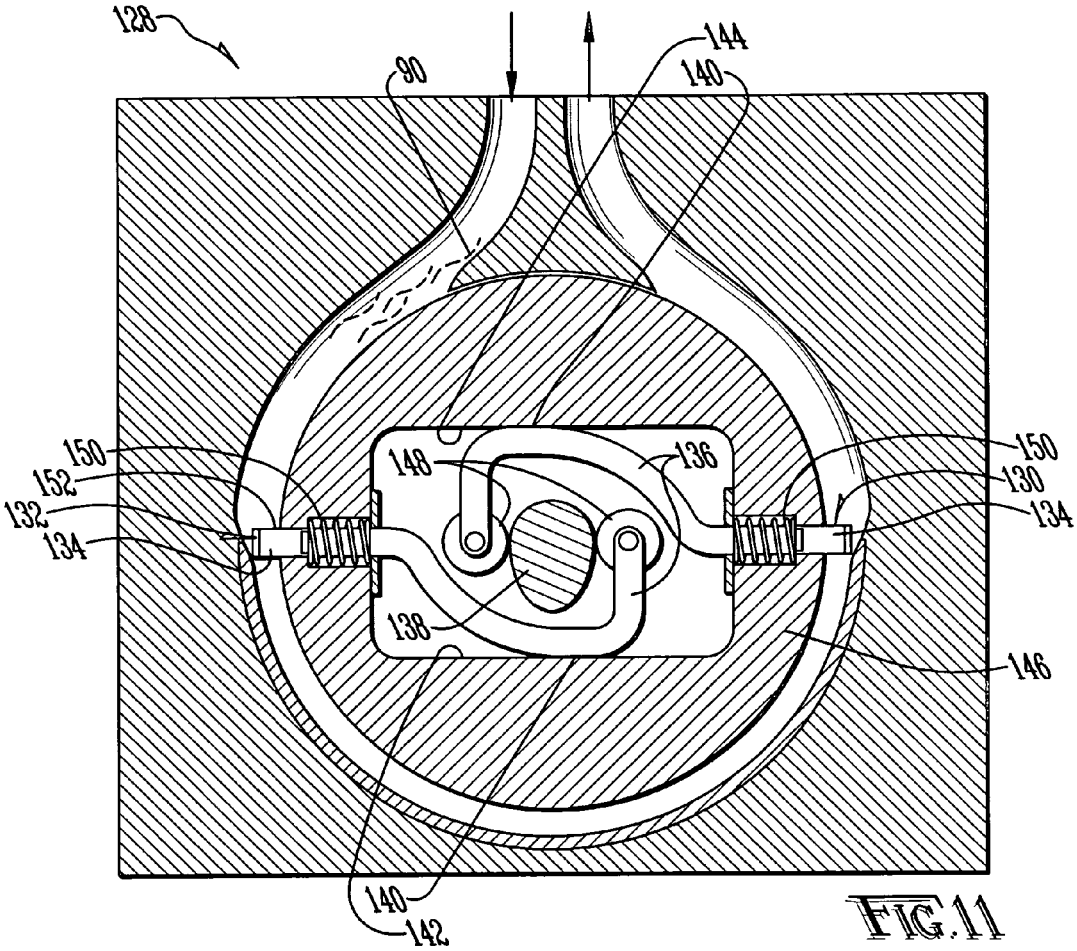
FIG. 11 illustrates a rear elevation cross-section of the motor of FIG. 9, shown with the vanes equally extended.

Shown in FIG. 9 is an alternative motor (128) of the present invention. The motor (128) incorporates a pair of modified vanes (130) and (132). As shown, the vanes (130) and (132) are provided with a lower portion (134) which is straight and an upper portion (136) which is provided with a curvature sufficient to avoid contact with the modified cam (138). The upper portion (136) of the vanes (130) and (132) is preferably provided on one side (140) with Teflon® or similar low-friction material. Similarly, two interior faces (142) and (144) of the modified inner drum (146) are also provided with Teflon® or similar low-friction material to allow the vanes (130) and (132) to slide back and forth, thereacross. As shown, each of the vanes (130) and (132) are provided with a bearing (148) constructed and journaled to the vanes (130) and (132) in a manner such as that described above in the preferred embodiment. As shown, the vanes (130) and (132) are coupled to springs (150), or similarly resilient material which bias the vanes (130) and (132) outward. Accordingly, as pressurized fluid (90) presses against a face (152) of the first vane (130), the vane (130) forces the inner drum (146) to rotate toward the orientation shown in FIG. 10. In the orientation shown in FIG. 10, the first vane (130) is at its maximum extension, while the second vane (132) is at its maximum retraction. As the pressurized fluid (90) continues to press against the face (152) of the first vane (130), the bearings (148) ride along the cam (138), coacting with the springs (150) to begin to retract the first vane (130) and begin to extend the second vane (132), as shown in FIG. 11.

Figure 12:
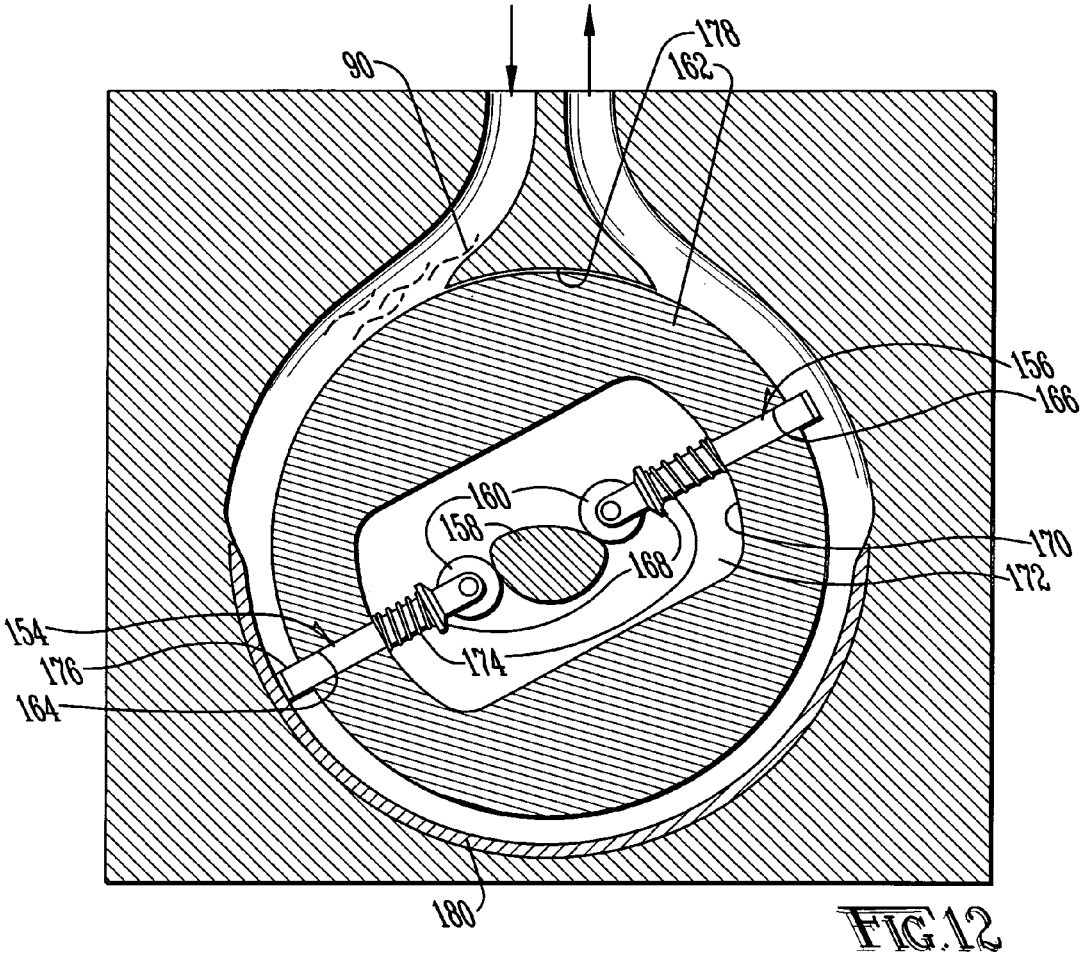
FIG. 12 illustrates a rear elevation cross-section of yet another alternative embodiment of the present invention.
Figure 13:
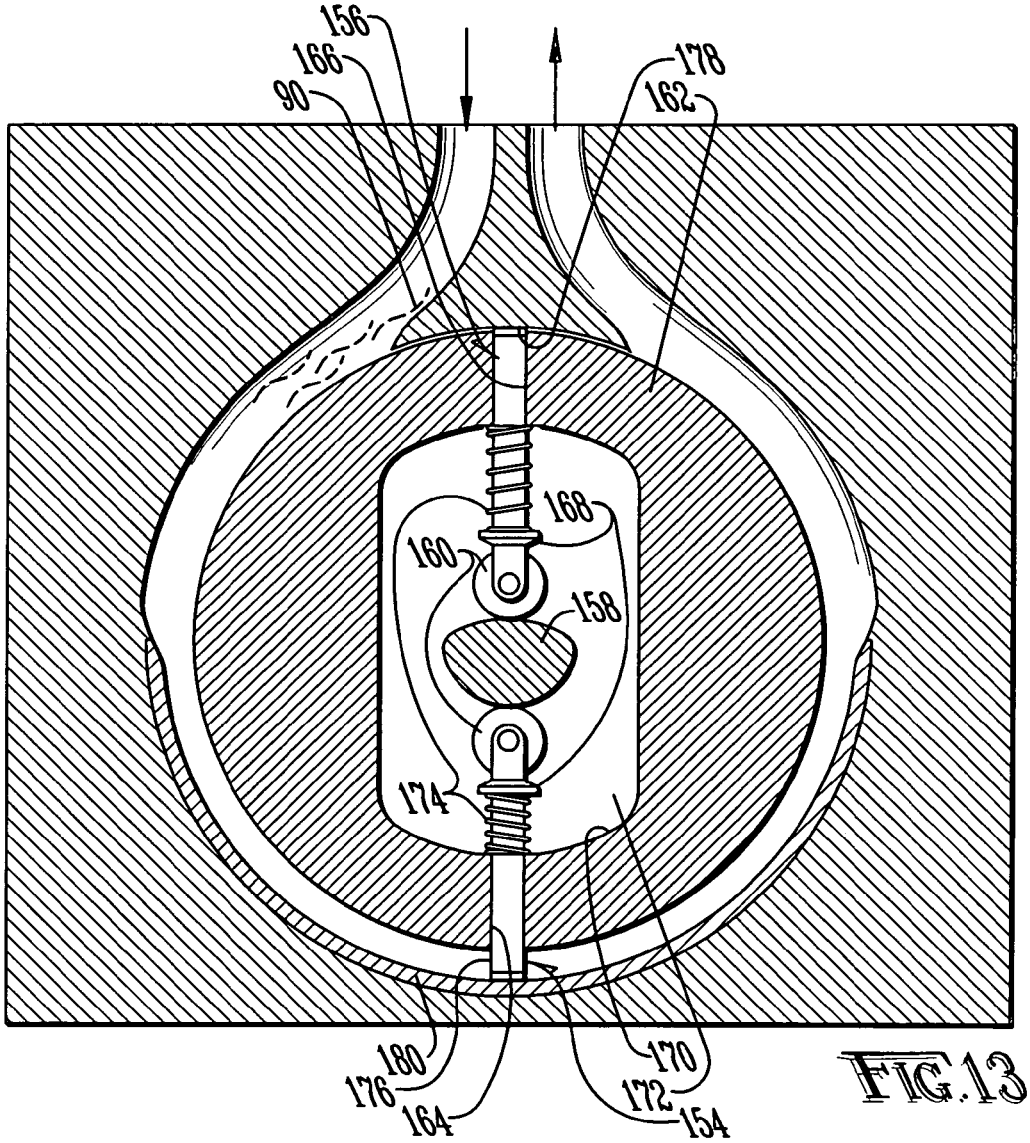
FIG. 13 illustrates a rear elevation cross-section of the motor of FIG. 12, shown with one vane fully retracted and one vane fully extended.
Figure 14:
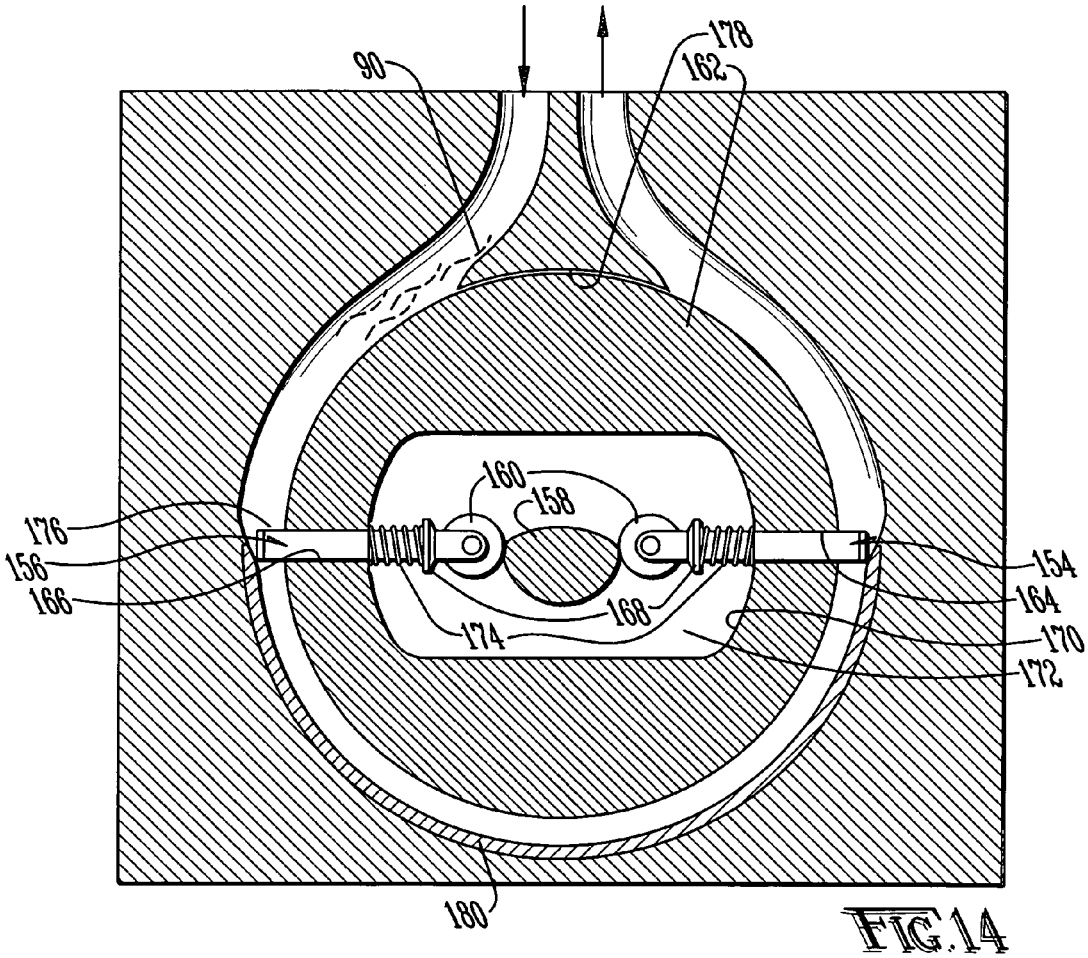
FIG. 14 illustrates a rear elevation cross-section of the motor of FIG. 12, shown with the vanes equally extended.

Shown in FIG. 12 is yet another alternative embodiment of the present invention, utilizing a first vane (154) and second vane (156), coupled to a modified cam (158) by a pair of bearings (160), constructed and coupled to the vanes (154) and (156) in a manner such as that described above. As shown in FIG. 12, the modified inner drum (162) is provided with a first slot (164) and a second slot (166), within which are provided the vanes (154) and (156). The vanes (154) and (156) are each provided with a collar (168), constructed of steel or similar material, and welded or otherwise secured to the vanes (154) and (156). Provided between the collars (168) and the exterior surface (170) of an interior (172) of the drum (162) is a spring (174), or similarly resilient material, biasing the vanes (154) and (156), and bearings (160), into the cam (158). Accordingly, as pressurized fluid (90) presses against the face (176) of the first vane (154), the drum (162) rotates toward the orientation shown in FIG. 13. As the pressurized fluid (90) continues to press against the face (176) of the first vane (154), the cam (158) and springs (174) coact to maintain the vanes (154) and (156) at the predetermined orientations relative to the drum (162), alternatively retracting the vanes (154) and (156) as the vanes pass by the ceiling (178), and extending them as they pass by the abrasion plate (180).

Figure 15:
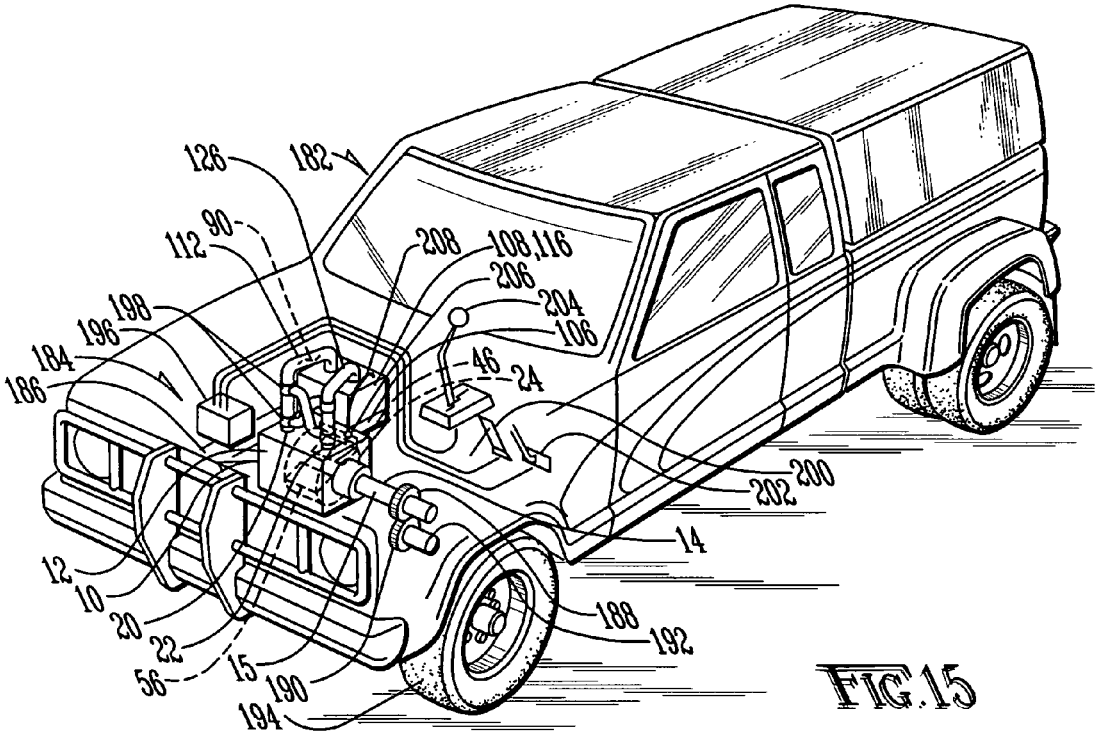
FIG. 15 illustrates a side perspective view in partial cutaway of a truck incorporating the motor of the present invention.

As shown in FIG. 15, the motor (10) may be used in association with a motor vehicle (182). The motor (10) is preferably positioned within the engine compartment (184), and secured to the frame (186) of the motor vehicle (182) by bolts (not shown), or by any manner such as those well known in the art. As shown, the drive shaft (14) is provided with a gear (188), operably coupled to another gear (190), secured to an axle (192). The axle (192), in turn, is connected to a pair of wheels (194) used to motivate the motor vehicle (182). On advantage of the motor (10) of the present invention is the efficient production of torque over a wide range of speeds. Accordingly, there is no need for a transmission, such as that used in the prior art. By eliminating the transmission and reverse gear, wear and maintenance of these parts is eliminated.

As shown in FIG. 15, the motor vehicle (182) is provided with an accelerator (200), brake (202) and reverse lever (204). The accelerator (200), brake (202) and reverse lever (204) are all electrically coupled to the computer controlled switching system (196). Of course, the accelerator (200), brake (202) and reverse lever (204) may be hydraulically, pneumatically or otherwise coupled to the computer controlled switching system (196). In operation, when it is desired to motivate the motor vehicle (182), a user depresses the accelerator (200), which signals the computer controlled switching system (196) to actuate valves (198) to allow pressurized fluid (90) to flow through the pressure hose (112), through the inlet (20), rotate the vanes (46) and (56), and exit the outlet (22) through the return hose (114), and return to the condenser (116) and heating chamber (108), where the water (110) is reheated by the heater (106). (FIGS. 1 and 15). When it is desired to slow the motor vehicle (182), the brake (202) is depressed, thereby signaling the computer controlled switching system (196) to close the valves (198). With the valves (198) closed, the wheels (194) of the motor vehicle (182) continue to rotate the axle (192), the gear (190), the gear (188), the drive shaft (15) and the vanes (46) and (56). As the vanes (46) and (56) continue to rotate, they continue to motivate and compress the pressurized fluid (90) contained within the hollow interior (24) of the motor (10) within the exhaust chamber (126). As the vanes (46) and (56) continue to rotate, the pressure of the pressurized fluid (90) within the exhaust chamber (126) continues to build and the temperature of the pressurized fluid (90) also increases.

As shown in FIG. 15, the casing (12) is provided with a blow-off valve (206) in fluid communication with the exhaust chamber (126). The blow-off valve (206) may, of course, be set at any desired temperature or pressure. Once this temperature or pressure is obtained, the blow-off valve (206) opens up communication of the exhaust chamber (126) with an overflow hose (208) to return the pressurized fluid (90) directly to the heating chamber (108). In this manner, energy is returned to the system by using rotation of the wheels (194) to motivate the vanes (46) and (56) and heat and pressurize the pressurized fluid (90) in the motor (10). Additionally, during braking, the computer controlled switching system (196) may be used to actuate the valves (198) to provide pressurized fluid (90) directly into the exhaust chamber (126) to provide a back pressure into the hollow interior (24) of the motor (10). This back pressure operates to slow the rotation of the vanes (46) and (56) and, in turn, the wheels (194) of the motor vehicle (182) more quickly, and provides a larger volume of pressurized fluid (90) to pressurize and heat, and return through the blow-off valve (206) and overflow hose (208) to the heating chamber (108). This provides added braking force, and an increased volume of pressurized fluid (90) to heat and pressurize during the braking operation.

If it is desired to reverse the motor vehicle (182), the reverse lever (204) is actuated, thereby signaling the computer controlled switching system (196) to actuate the valves (198) to reverse the flow of pressurized fluid (90) through the hollow interior (24) of the motor. When the reverse lever (204) is actuated, the valves (198) direct the pressurized fluid (90) directly into the exhaust chamber (126). By reversing the flow of pressurized fluid (90) through the hollow interior (24), the vanes (46) and (56) rotate the drive shaft (14) in a reverse direction which, in turn, rotates the gears (188) and (190) in a reverse direction, thereby rotating the axle (192) and wheels (194) in a reverse direction as well. If desired, the reverse lever (204) may be used as an alternative to the brake (202) to provide the most braking assist to the motor vehicle (182). Accordingly, not only does this assembly reduce the need for high wear pads or shoes in a braking system, but also extracts energy from the braking process and returns the energy to the heating chamber (108) in the form of pressurized fluid (90), having increased heat and/or pressure.

Figure 16:
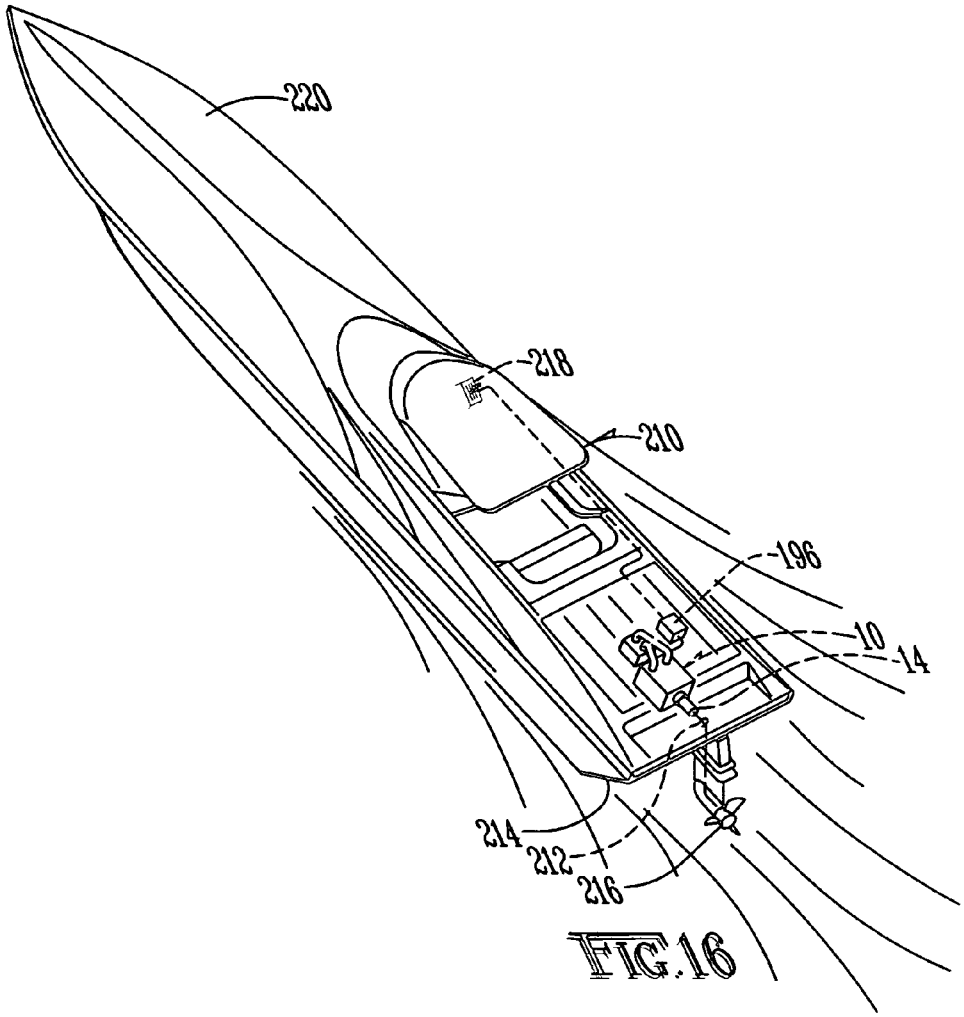
FIG. 16 illustrates a side perspective view in partial cutaway of a watercraft incorporating the motor of the present invention.

As shown in FIG. 16, the motor (10) may be used in association with large or small watercraft (210). In this adaptation of the motor (10), the drive shaft (14) extends through an aperture (212) provided in the stern (214) of the watercraft (210). The drive shaft (14) is secured to a propeller (216), such as those well known in the art. In this application as well, the computer controlled switching system (196) is coupled to a throttle lever (218). When the throttle lever (218) is pushed toward the bow (220) of the watercraft (210), the motor (10) turns the propeller (216) to motivate the watercraft (210). When the throttle lever (218) is pulled toward the stern (214) of the watercraft (210), the computer controlled switching system (196) reverses the flow of pressurized fluid (90) through the motor (10), thereby providing braking and reversing the watercraft (210), and eliminating the need for a separate reverse gear. Also, as the motor (10) produces sufficient torque over a wide range of speeds, there is no need for a standard transmission. It should be noted that the motor (10) may be used in watercraft ranging from personal watercraft to large ships, with the motor (10) being sized and constructed to accommodate such diverse applications.

Figure 17:
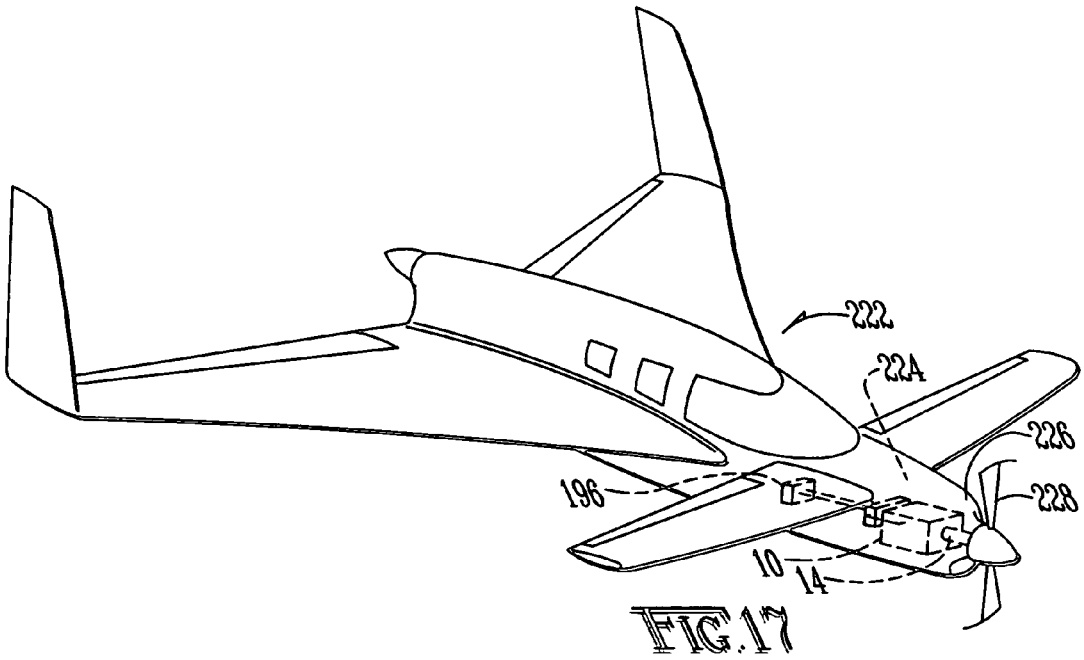
FIG. 17 illustrates a top perspective view in partial cutaway of a propeller driven aircraft incorporating the motor of the present invention.

As shown in FIG. 17, the motor (10) may be adapted for use in a propeller driven aircraft (222). The motor (10) is preferably provided within the engine compartment (224) of the aircraft (222) with the drive shaft (14) extending through the front (226) of the propeller driven aircraft (222). The drive shaft (14) is coupled directly to a propeller (228) without the need for intermediate gearing or a transmission. The computer controlled switching system (196) is coupled directly to the motor (10) to allow reversing of the propeller (228) for use when the aircraft (222) is on the ground.

Figure 18:
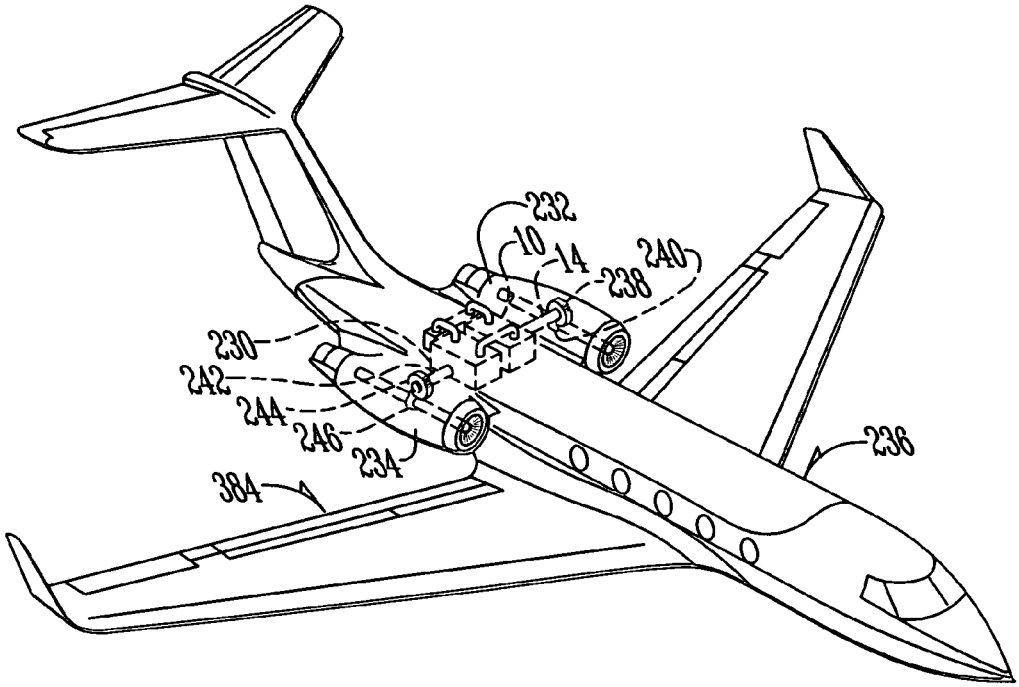
FIG. 18 illustrates a top perspective view in partial cutaway of a turban driven aircraft incorporating the motor of the present invention.

In yet another application of the motor (10) of the present invention, as shown in FIG. 18, the motor (10) may be used in conjunction with an auxiliary motor (230) to drive a first turbine (232) and second turbine (234) of a turbine driven aircraft (236). In the preferred embodiment, the drive shaft (14) of the motor (10) is provided with a large gear (238) which is coupled to a smaller gear (240) which, in turn, is coupled to the first turbine (232) in a manner such as that known in the art. Similarly, an auxiliary drive shaft (242) coupled to the auxiliary motor (230) is provided with a large gear (244) which, in turn, is coupled to a smaller gear (246) coupled to the second turbine (234) in a manner such as that known in the art.

Figure 19:
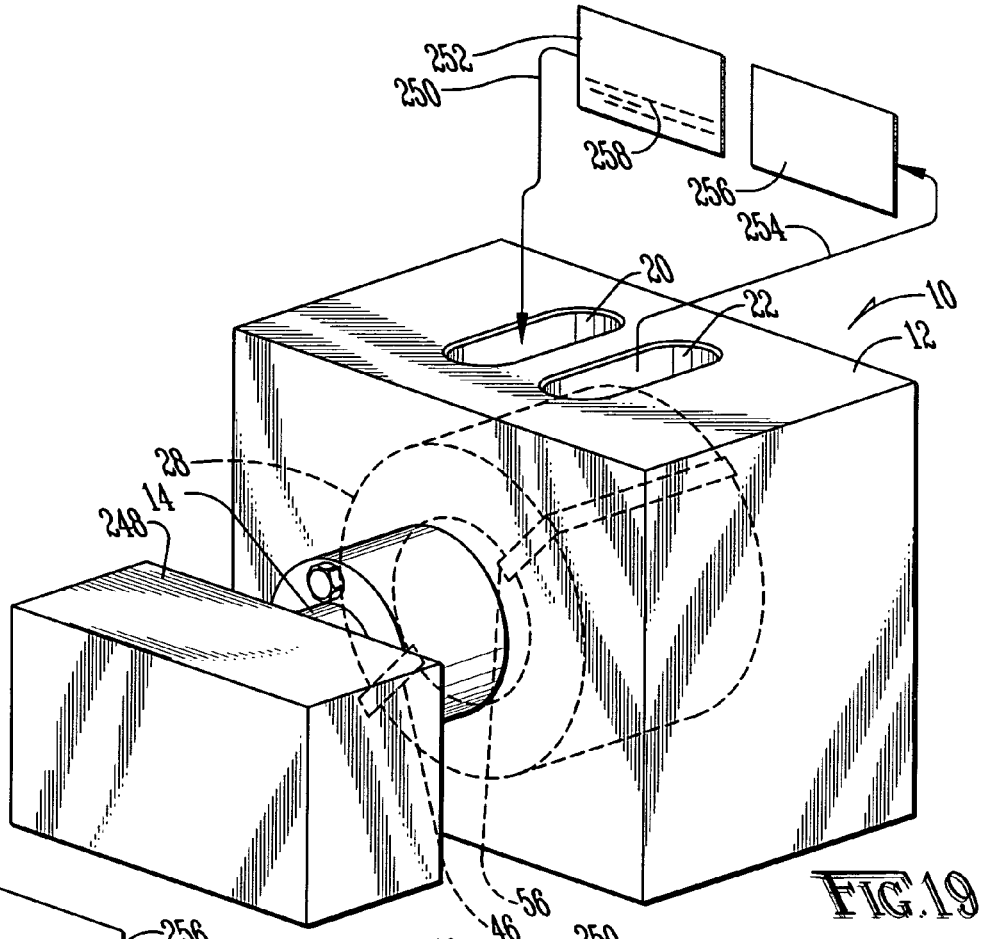
FIG. 19 illustrates a front perspective view of an alternative embodiment of the present invention utilizing a driver to rotate the interior drum.
Figure 20:
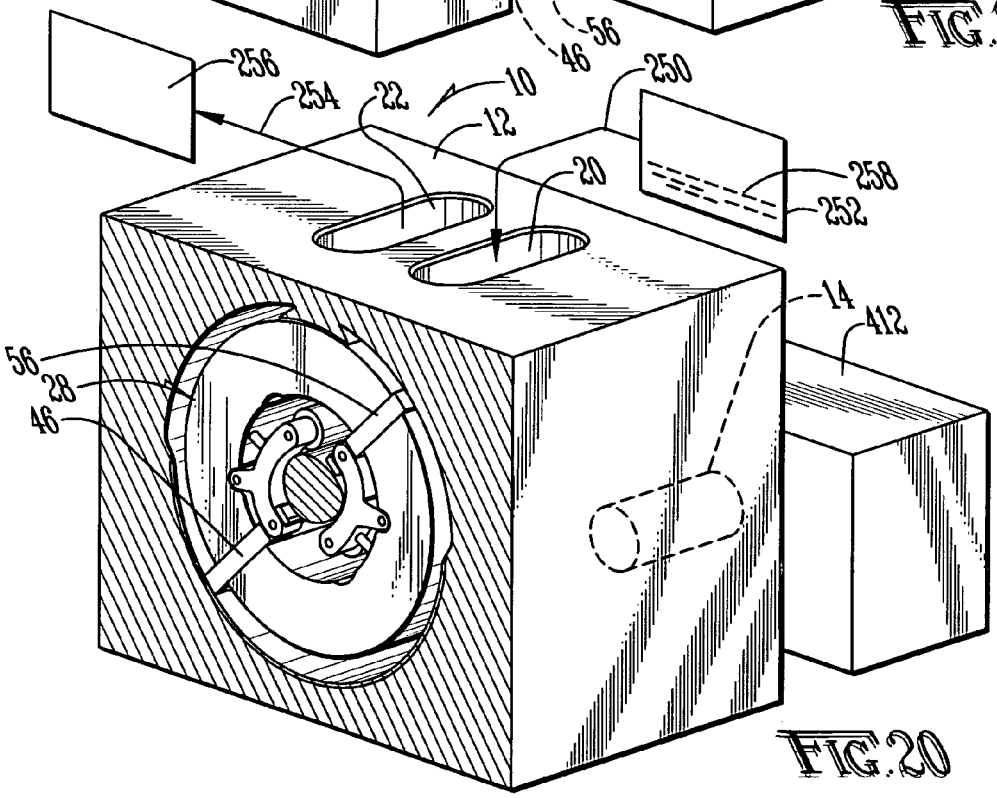
FIG. 20 illustrates a rear perspective view of the motor of FIG. 19, shown with the rear of the case and bushings removed.

In yet another alternative embodiment of the present invention, the motor (10) is coupled to a rotational motion generator (248), such as a gasoline engine, a diesel engine, an electric engine or other rotational motion generator such as those known in the art. As shown in FIGS. 19–20, a suction hose (250) is coupled on one end to the inlet (20) and provided with its other end in a fluid supply (252), such as a fluid spill or container to which it is desired to apply a vacuum. Coupled to the outlet (22) is an exhaust hose (254) which, in turn, is provided into communication with a receptacle (256), such as a barrel, drum or drain. When it is desired to operate the motor (10) as a pump, the rotational motion generator (248) is actuated to rotate the drive shaft (14). As the drive shaft (14) rotates, the inner drum (28) revolves, causing the vanes (46) and (56) to alternatively extend and retract relative to the inner drum (28), as described above, to generate a vacuum and draw fluid (258), such as water or a gas, from the fluid supply (252) through the suction hose (250). (FIGS. 19 and (20). Upon entering the casing (12), the fluid (258) is driven by the vanes (46) and (56) out of the outlet (22) through the exhaust hose (254) and into the receptacle (256). If it is desired to move the fluid (258), from the receptacle (256) to the fluid supply (252), the rotational motion generator (248) is simply reversed, thereby causing the vanes (46) and (56) to reverse their motion and drive the fluid (258) in a reverse direction through the motor (10) and back out through the suction hose (250).

Although the invention has been described with respect to a preferred embodiment thereof, it is to be also understood that it is not to be so limited, since changes and modifications can be made therein which are within the full intended scope of this invention as defined by the appended claims. It is anticipated that the motor may be constructed of any suitable size, ranging in sizes from less than a millimeter to several meters in diameter. It is also anticipated that any suitable pressurized fluid, such as pressurized air, pressurized water, pressurized silicon or any liquid or gas may be used to rotate the vanes (46) and (56).

What is claimed is:

1. A motor comprising:

(a) a housing defining a fluid input and a fluid output in fluid communication with an interior;

(b) a vane provided within said housing;

(c) a cam provided within said housing, wherein said cam is constructed in a manner so as to substantially prevent contact of said vane with said housing;

(d) a follower operably coupled to said vane;

(e) means for maintaining said follower in contact with said cam, and (f) a curved arm operably coupling said vane to said follower.

2. The motor of claim 1, wherein said follower is a wheel.

3. The motor of claim 2, wherein said housing defines a front sealing surface and a rear sealing surface, and wherein said vane extends substantially from sealing engagement with said front sealing surface to sealing engagement with said rear sealing surface.

4. The motor of claim 1, wherein said maintaining means is resilient.

5. The motor of claim 1, wherein said maintaining means is a spring.

6. The motor of claim 1, wherein said cam is located interior of said follower.

7. The motor of claim 1, wherein said housing defines an arcuate surface.

8. The motor of claim 7, further comprising a drum provided within said interior.

9. The motor of claim 8, wherein said cam and said follower are located within said drum.

10. A motor comprising:

(a) a housing defining a fluid input and a fluid output in fluid communication with an interior.

(b) a drum provided within said housing, said drum defining a slot;

(c) a vane provided within said slot;

(d) a follower operably coupled to said vane;

(e) a cam provided within said drum, wherein said cam is positioned interior of said follower, and (f) a curved arm operably coupling said vane to said follower.

11. The motor of claim 10, further comprising means for maintaining said follower in contact with said cam.

12. The motor of claim 10, wherein said follower is a wheel.

13. The motor of claim 10, wherein said cam is constructed in a manner so as to substantially prevent contact of said vane with said housing.

14. The motor of claim 10, wherein said housing defines an arcuate surface.

15. A motor comprising:

(a) a housing defining a fluid input and a fluid output in fluid communication with an interior;

(b) a vane provided within said housing;

(c) a cam provided within said housing;

(d) a follower operably coupled to said vane;

(e) means for maintaining said follower in contact with said cam, and (f) a curved arm operably coupling said vane to said follower.

16. The motor of claim 15, wherein said cam is constructed in a manner so as to substantially prevent contact of said vane with said housing.

17. The motor of claim 15, wherein said housing defines an arcuate surface.

* * * * *